US008714701B2

(12) United States Patent
Saeki

(10) Patent No.: US 8,714,701 B2
(45) Date of Patent: May 6, 2014

(54) INKJET PRINTING APPARATUS AND A METHOD OF TRANSFERRING A WETTING LIQUID

(75) Inventor: Tsuyoshi Saeki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 123 days.

(21) Appl. No.: 13/074,526

(22) Filed: Mar. 29, 2011

(65) Prior Publication Data

US 2011/0242202 A1 Oct. 6, 2011

(30) Foreign Application Priority Data

Apr. 2, 2010 (JP) ..... 2010-086026

(51) Int. Cl.
*B41J 2/165* (2006.01)

(52) U.S. Cl.
USPC ..... 347/33

(58) Field of Classification Search
USPC ..... 347/33
See application file for complete search history.

(56) References Cited

U.S. PATENT DOCUMENTS

| | | | |
|---|---|---|---|
| 5,905,514 | A | 5/1999 | Rhoads et al. |
| 8,201,919 | B2 | 6/2012 | Mizoguchi et al. |
| 2007/0279452 | A1 | 12/2007 | Mizoguchi et al. |

FOREIGN PATENT DOCUMENTS

| | | | |
|---|---|---|---|
| JP | 06-079879 | A | 3/1994 |
| JP | 2007-320165 | A | 12/2007 |
| JP | 2009-101630 | A | 5/2009 |

*Primary Examiner* — Justin Seo
(74) *Attorney, Agent, or Firm* — Fitzpatrick, Cella, Harper & Scinto

(57) ABSTRACT

There are provided an inkjet printing apparatus and a wiping method which are capable of reducing the load on a wiper. A wetting liquid retaining unit 140 including a transferring portion 221 making contact with the wiper 120 to transfer the wetting liquid is moved to a first position where contact with the wiper is possible and a second position where contact with the wiper is impossible. Drag generated by movement of the wiper 120 does not act on it and the transferring portion 221 can make contact with the wiper 120 in the Z direction (vertical direction). So, while the wiper 120 is not almost acted upon by drag in the thickness direction (Y direction) and the width direction (X direction) and rubbing against the transferring portion, the wetting liquid can be transferred with drag in the height direction (Z direction) alone in which relatively flexible deformation is allowed.

11 Claims, 10 Drawing Sheets

INKJET PRINTING APPARATUS AND A METHOD OF TRANSFERRING A WETTING LIQUID

BACKGROUND OF THE INVENTION

1. Field of the Invention

This invention relate to wiping of an inkjet print head, and a method of transferring a wetting liquid (solvent) to a wiper blade used in the wiping.

2. Description of the Related Art

U.S. Pat. No. 5,905,514 discloses a technique to wipe an ejection opening face with a wiper to which a low-volatile solvent (wetting liquid) is transferred one time for uniformizing the moistened state of the ejection opening at each wiping. For example, glycerin, polyethylene glycol or the like is used for the wetting liquid, which can dissolve a build-up of thickened ink or a built-up film deposited on the nozzle face. The interposition of the wetting liquid between the wiper and the nozzle face allows the wetting liquid to function as a lubricant, thus facilitating removal of foreign substance by wiping and protecting the ejection opening face. Wiping in which a low-volatile wetting liquid is transferred to a wiper one time and the wiper is used to wipe an ejection opening face as disclosed in U.S. Pat. No. 5,905,514 is hereinafter referred to as "wet wiping".

In the wet wiping, a wetting liquid retaining member for receiving a wetting liquid and a transfer portion for applying a coat of the received wetting liquid to the wiper are provided in the main body of the printing apparatus. Typically, a fibrous member is used as the transfer portion, which is impregnated with the wetting liquid in the wetting liquid retaining member and stands by in that state. Then, the wiper is moved to come into contact with the transfer portion, so that a predetermined amount of the wetting liquid is transferred to the wiper. By performing a wiping operation to an ejection opening face of a print head using the wiper to which a wetting liquid is transferred in such a process, a preferred amount of the wetting liquid is applied to the ejection opening face.

In such wet wiping, the stability of the amount of the wetting liquid transferred to the wiper is desired for the purpose of maintaining ejection stability of the print head. However, the amount of the wetting liquid stored in the wetting liquid retaining member is decreased as the number of wiping operations is increased, along with which the speed at which the transfer portion is impregnated with the wetting liquid in the wetting liquid retaining member is decreased. As a result, the amount of the wetting liquid transferred to the wiper is also gradually decreased.

U.S. Patent publication No. 2007/0279452 discloses a technique for changing the amount of contact between the transfer portion and the wiper according to the amount of the wetting liquid remaining in the wetting liquid retaining member for the purpose of preventing such a reduction of the amount of the wetting liquid transferred to the wiper. Specifically, when the amount of the wetting liquid remaining in the wetting liquid retaining member is reduced to be equal to or less than a predetermined amount, the wetting liquid retaining member and the transfer portion go into standby in a downward moved position. By doing so, the intrusion amount of the wiper moving to make contact with the transfer portion (the length of a portion actually making contact with the transfer portion) is greater than that before those are moved downward, resulting in an increase in the contact area to which the wetting liquid can be transferred. Thus, even when a remaining amount of the wetting liquid is reduced to be small in the wetting liquid retaining member, it is possible to maintain a stable amount of wetting liquid application without a reduction in the amount of the wetting liquid applied to the wiper irrespective of the frequency and the duration of use of the printing apparatus.

In the structure in the related art, however, since the wiper horizontally moved makes contact with the transfer portion on standby, the wiper is acted upon by drag not only in the direction in which the wiper makes contact with the transfer portion but also in the moving direction of the wiper. In particular, in the structure disclosed in U.S. Patent publication No. 2007/0279452, as the amount of the wetting liquid remaining becomes the lower, the more the transfer portion is moved downward, resulting in a large intrusion amount of the wiper and an increased load thereon. Such a load is applied every time the wiper is moved to or evacuated from the transfer portion, that is, in each wiping operation, which accelerates deterioration of the wiper to cause shorter life.

SUMMARY OF THE INVENTION

The present invention has been made to address these disadvantageous problems. It is an object of the present invention to provide an inkjet printing apparatus and a wiping method which are capable of reducing the load on a wiper and also reliably transferring a wetting liquid to the wiper in a structure in which the wiper and a transfer portion are brought into contact with each other to transfer the wetting liquid on the transfer portion to the wiper.

In a first aspect of the present invention, there is provided an inkjet printing apparatus performing printing by use of a print head having an ejection opening face in which ejection openings are formed to eject ink, comprising: a wiper for wiping the ejection opening face; a wetting liquid retaining unit including a transferring portion coming into contact with the wiper to transfer a wetting liquid to the wiper; and a retaining-unit moving unit configured to move the wetting liquid retaining unit to a first position in which contact with the wiper is allowed, and to a second position in which contact with the wiper is not allowed, wherein the retaining-unit moving unit moves the wetting liquid retaining unit from the second position to the first position to allow the wiper and the transferring portion to come into contact with each other.

In a second aspect of the present invention, there is provided a method of transferring a wetting liquid in an inkjet printing apparatus provided with a print head having an ejection opening face in which ejection openings are formed to eject ink, a wiper for wiping the ejection opening face, a wetting liquid retaining unit including a transferring portion coming into contact with the wiper to transfer a wetting liquid to the wiper, comprising: a step to move the wetting liquid retaining unit from a first position in which contact with the wiper is allowed to a second position in which contact with the wiper is not allowed; a step to move the wiper to a transfer position in which contact with the transferring portion is allowed; and a step to move the wetting liquid retaining unit from the second position to the first position to provide contact between the wiper and transferring portion.

Further features of the present invention will become apparent from the following description of exemplary embodiments with reference to the attached drawings.

DESCRIPTION OF THE EMBODIMENTS (Embodiment 1)

Figure 1:
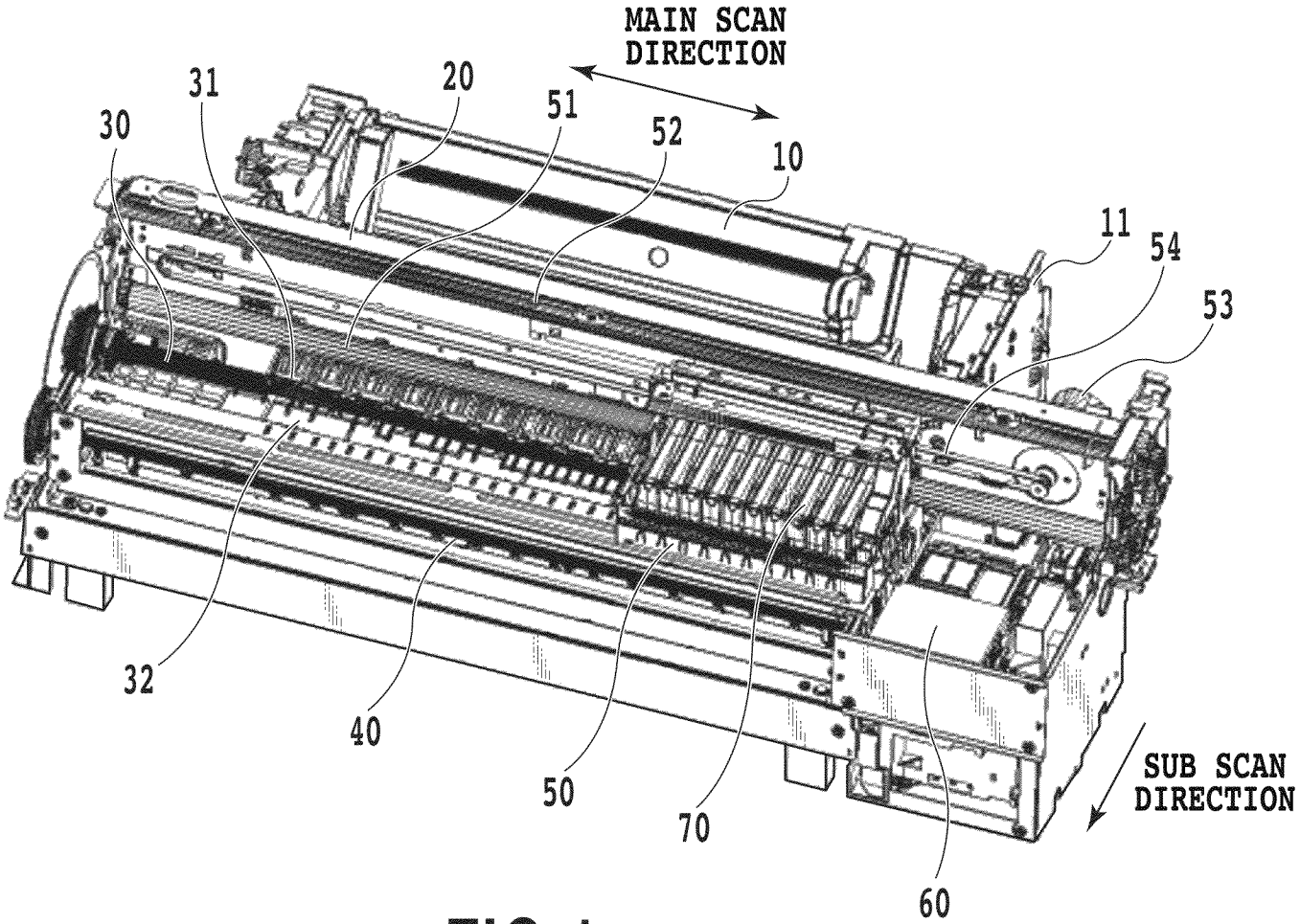
FIG. 1 is a perspective view illustrating a schematic structure of an inkjet printing apparatus available in the present invention.

FIG. 1 is a perspective view illustrating the schematic structure of an inkjet printing apparatus available in the present invention. Mechanisms of the printing apparatus employed in the present embodiment can be schematically classified into a paper feed mechanism, a sheet conveying mechanism, a paper discharge mechanism, a carriage mechanism, a recovery mechanism and the like according to roles of the respective mechanisms.

The paper feed mechanism includes a base 11 mounted with a pressure plate 10 holding mainly print medium mounted thereon to be printed, a feed roller for feeding sheets of the print medium one by one, and the like. Upon reception of a print command, a topmost sheet of the print medium on the pressure plate 10 is fed to the printing area within the apparatus as a feed roller in contact with the topmost sheet is rotated. The print medium fed by the feed mechanism is then conveyed by the sheet conveying mechanism.

The sheet conveying mechanism is constructed mainly of a conveying roller 30 attached to a chassis 20, pinch rollers 31 which are driven by contact with the conveying roller 30, an LF motor (not shown) for operating the rotation of the conveying roller 30, and a platen 32 supporting the print medium located in the printing area from underneath. The print medium fed by the feed mechanism is fed to a nip between the conveying roller 30 and the pinch rollers 31, and then conveyed in the sub scan direction shown in FIG. 1 while being supported between the rollers 30 and 31. In the area where the print head can print in the midway of the conveying course, ribs formed on the platen 32 support the print medium from underneath such that the print medium is maintained in parallel to the ejection opening face of the print head at a predetermined distance. A portion of the print medium after being printed is then sent to the discharge mechanism.

The discharge mechanism is constructed mainly of a discharge roller 40 operated by the LF motor as the drive source, and spurs (not shown) driven by contact with the discharge roller 40. The print medium after being printed is gradually discharged from the apparatus while being supported in a nip between the discharge roller 40 and the spurs.

An image is printed on a print area of the print medium during the conveyance by the print head mounted on a carriage 50. The carriage mechanism is constructed mainly of the carriage 50 mounted with the print head and moving in the main scan direction shown in FIG. 1, a guide shaft 51, a guide rail 52, a carriage motor 53 and a timing belt 54. The carriage 50 is mounted with the print head and ink tanks 70 for supplying ink to the print head. The carriage 50 can be moved through the timing belt 54 by the carriage motor 53 as the drive source attached to the chassis 20. The guide shaft 51 supports the carriage 50 and guides it in the main scan direction. The guide rail 52 holds the rear end of the carriage 50 and plays a role in maintaining a gap between the print head and the print medium. In the present embodiment, the ink tanks 70 are assumed to store 10 kinds of colors of ink containing watercolor pigments and differing in hue from each other.

In the above structure, when an image is generated on a print medium, a roller pair made up of the conveying roller 30 and the pinch rollers 31 convey the print medium to a correct position for row positioning. Also, for column positioning, the carriage 50 is moved in a direction perpendicular to the conveying direction to align the print head with a target image generating position. The print head ejects ink onto the print medium in response to a signal from an electric substrate. The printing apparatus in the present embodiment is constructed to repeat the print main scan and the operation of conveying the print medium in alternate order to form an image on the print medium in stages.

Figure 2:
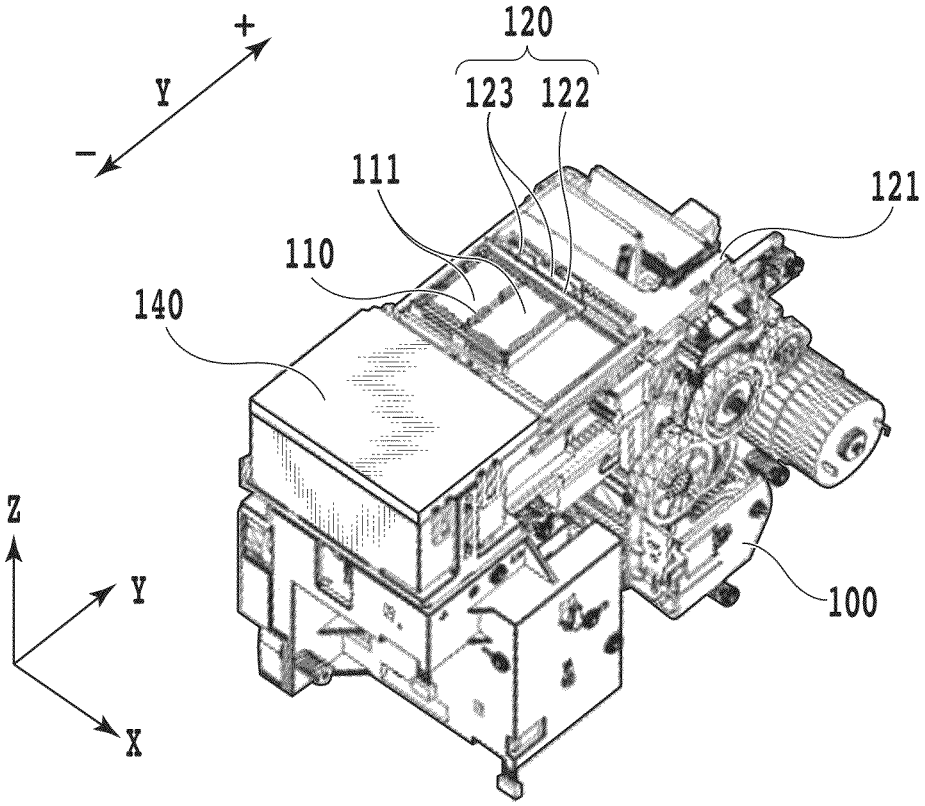
FIG. 2 is a perspective view illustrating the structure of a recovery mechanism available in the present invention.

FIG. 2 is a perspective view illustrating the structure of a recovery mechanism in the printing apparatus in the present embodiment. The recovery mechanism includes a suction pump 100 for sucking ink from the ejection opening of the print head, a cap 110 covering the vicinity of the ejection opening of the print head to reduce drying, a wiper 120 for wiping the vicinity of the ejection opening of the print head, a wetting liquid retaining unit 190 and the like. The power source in the above structure is derived from a feed motor B105 serving mainly as a power source of the feed mechanism. Specifically, a one-way clutch (not shown) is provided such that the rotation in one direction of the feed motor B105 operates the suction pump 100 and the rotation in the other direction moves the cap 110 for the close contact/separating operation and moves the wiper 120 for the wiping operation. However, the wetting liquid retaining unit 140 is moved upward/downward by a lift motor B106 as a power source provided separately from the feed motor B105.

The suction pump 100 can develop a negative pressure in the cap 110 when the cap 110 is joined to the ejection opening face of the print head to form an enclosed space in the cap 110. This makes it possible to deliver ink from the ink tank 70 to fill an area close to the ejection opening of the print head with the ink, and to suck and remove dust, adherents, foam/bubbles, and the like which exist in the ejection opening or in the ink passage inside the ejection opening.

For example, a tube pump form may be employed as the suction pump 100. The tube pump has a flexible tube, a member with a curved face formed thereon for holding at least a portion of the flexible tube extending along the curved face, a roller capable of pressing the flexible tube against the member, and a roller supporting element supporting the roller while rotating. The roller supporting element is rotated in a predetermined direction while the cap 110 is being pressed against the ejection opening face. Thus, the roller can rotate while pressing down the flexible tube onto the curved face of the member, to develop a negative pressure in the enclosed space formed in the cap 110. As a result, the ink is sucked from the ejection opening into the cap 110, and also drawn into the tube or the suction pump 100, and then delivered toward an ink absorption member (not shown) provided further downstream.

Typically, a cap absorption element 111 is provided inside the cap 110 for reducing the ink remaining on the ejection opening of the print head after the sucking. While the cap 110 is being uncapped, the ink remaining in the cap 110 or the cap absorption element 111 is sucked in order to give consideration to prevent the remaining ink from changing into an adherent and from causing negative effects in future. Preferably, an air relief valve (not shown) is provided on the ink suction route in order to open the air relief valve before the cap 110 is moved away from the ejection opening face to prevent the negative pressure rapidly produced from acting on the nozzle face.

In addition to the suction recovery, the suction pump 100 is able to be actuated for discharging the ink received by the cap 110 by ejecting the ink not contributing to image printing from the print head to the cap 110, in other words, by a preliminary ejection operation. That is, when the ink preliminary-ejected and held in the cap 110 reaches a predetermined amount, the suction pump 100 can be actuated to deliver the ink held in the cap 110 through the tube to the ink absorption member. The preliminary ejection operation is carried out when the cap 110 is positioned to face the ejection opening face.

The cap 110 is driven to move upward/downward in the Z direction via a lifting mechanism (not shown) by the feed motor B105. The cap 110 caps the ejection opening face of the print head in a lift-up position. In the present embodiment, ejection opening arrays from which the inks of 10 colors (10 arrays) different from each other are ejected are arranged in the print head. The two caps 110 are provided, each cap 110 being assigned to the five ejection opening arrays. The capping makes it possible to protect the ejection opening face in the non-printing operation and the like or to implement the suction recovery. During the printing operation, the cap 110 is placed in a lift-down position to avoid interference with the print head. The cap 110 can receive preliminary-ejected ink droplets in the lift-down position.

One end of the wiper 120 formed of an elastic member such as rubber or the like is secured to a wiper holder 121 that can reciprocate in the Y direction (the direction of ejection-opening arrangement in the ejection portion). When the print head is within the movable range of the wiper 120, the movement of the wiper holder 121 from the standby position for the −Y direction allows execution of the wiping process for the ejection opening face. Upon termination of the wiping operation, the carriage 40 is evacuated in the X direction (main scan direction) out of the wiping area, and then the wiper holder 121 is moved to the +Y direction to move the wiper 120 back to a standby position out of contact with the ejection opening face. In the present embodiment, the wiper 120 falls into two broad categories, a tab wiper 122 that wipes the entire ejection opening face and a nozzle wiper 123 that wipes the vicinity of the nozzle. After the completion of the wiping process, the wiper 120 is moved to the −Y direction again to make contact with an attached wiper cleaner (not shown) to remove ink adhering to the surface of the wiper.

In the present embodiment, the wetting liquid contained in the wetting liquid retaining unit 140 is transferred drop by drop onto the wiper 120, so that the wiping process is performed with the wiper 120 transferred the wetting liquid. This thus makes it possible to prevent deterioration of the nozzle face by the pigment ink and a reduction in abrasion of the wiper 120, as well as to dissolve ink resides accumulated on the nozzle face to remove the deposits.

Figure 3:
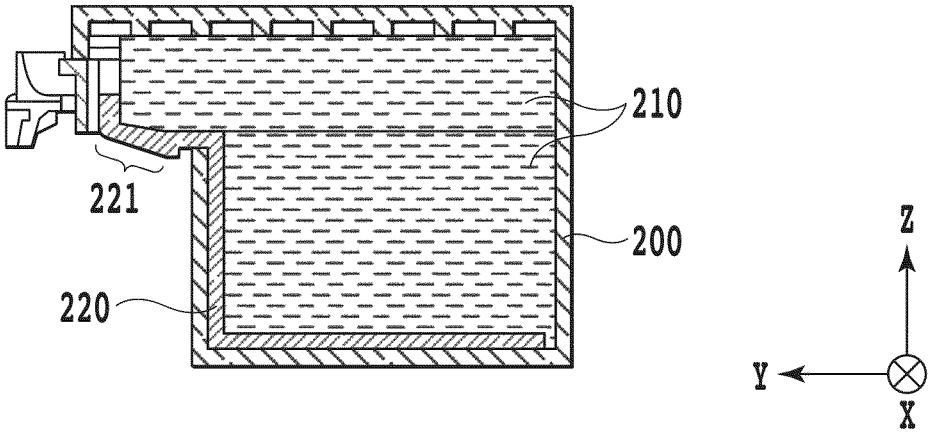
FIG. 3 is an enlarged sectional diagram of a wetting liquid retaining unit.

FIG. 3 is an enlarged sectional diagram of the wetting liquid retaining unit 140. A wetting liquid tank 200 contains a glycerin solution and/or the like as a wetting liquid. A wetting liquid retaining member 210 is formed of a fibrous member and/or the like having an appropriate surface tension, and is impregnated with the wetting liquid. The wetting liquid retaining member 210, which develops an appropriate negative pressure, is disposed in the tank, so that the wetting liquid can be kept within the wetting liquid tank 200 even when the volume of the wetting liquid is somewhat increased by a change in environment or the like.

The wetting liquid transfer member 220 is made of, for example, a porous material having an appropriate capillary force, and has a wetting liquid transferring portion 221 exposed for making contact with the wiper 120. The material of the wetting liquid transfer member 220 has a greater capillary force than that of the wetting liquid retaining member 210. The wetting liquid transfer member 220 is disposed in contact with the wetting liquid retaining member 210 and along the inner wall of the wetting liquid tank 200 as illustrated in FIG. 3, and contains the wetting liquid as in the case of the wetting liquid retaining member 210. By such a structure, even when the amount of the wetting liquid in the tank is low, the wetting liquid collects into the wetting liquid transfer member 220 to prevent interruption of the supply of wetting liquid to the wetting liquid transferring portion 221 as much as possible.

Figure 4A:
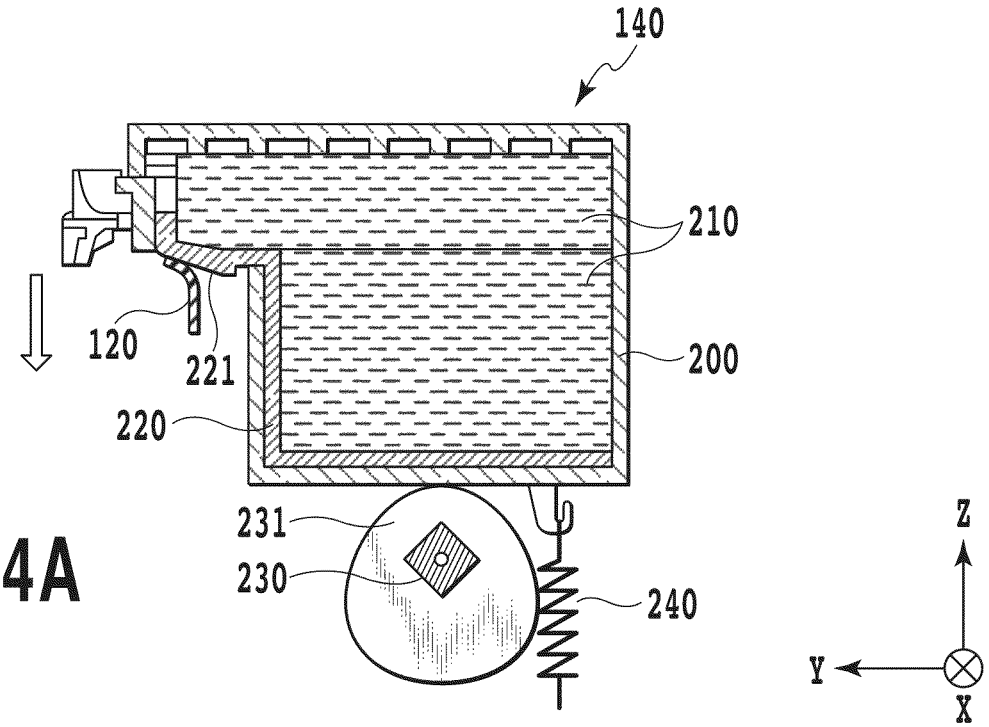
FIGS. 4A and 4B are diagrams illustrating two positions (a first position and a second position) to which the wetting liquid retaining unit can be moved.
Figure 9A:
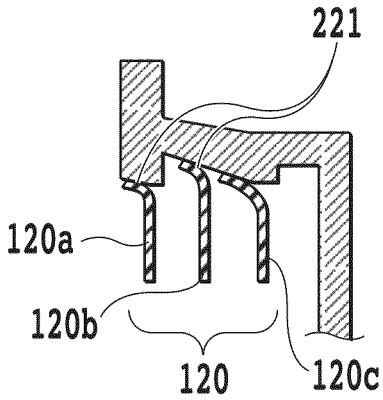
FIGS. 9A to 9C are diagrams illustrating other examples of the transferring portion with the three wipers.
Figure 9B:
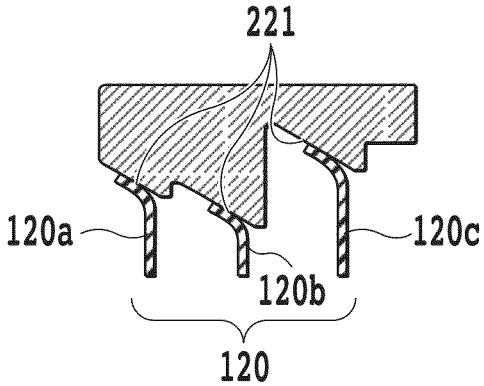

FIGS. 4A and 9B are diagrams illustrating two positions (a first position and a second position) to which the wetting liquid retaining unit 140 is moved by retaining-unit moving means. FIG. 4A shows the first position (transfer position) of the wetting liquid retaining unit 140 moved downward to be able to transfer the wetting liquid to the wiper 120. In FIG. 4A, the transferring portion 221 is in contact with the wiper 120 to transfer the wetting liquid. On the other hand, FIG. 4B illustrates the second portion (evacuation position) of the wetting liquid retaining unit 140 moved upward so that the wetting liquid transferring portion 221 cannot make contact with the wiper 120 even when the wiper 120 is moved to the transferable position.

Figure 5:
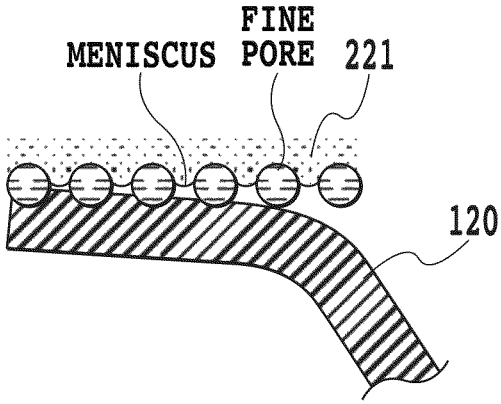
FIG. 5 is an enlarged diagram illustrating a state when the wetting liquid is transferred from a transferring portion to the wiper.

FIG. 5 is an enlarged diagram illustrating conditions when the wetting liquid is transferred from the transferring portion 221 to the wiper 120. The transferring portion 221 has numerous fine pores in which the wetting liquid forms meniscus. When the wiper 120 makes contact with the transferring portion 221 in this state, the meniscus is broken by the contact element, so that the surface of the wiper 120 becomes wet with the wetting liquid.

Figure 4B:
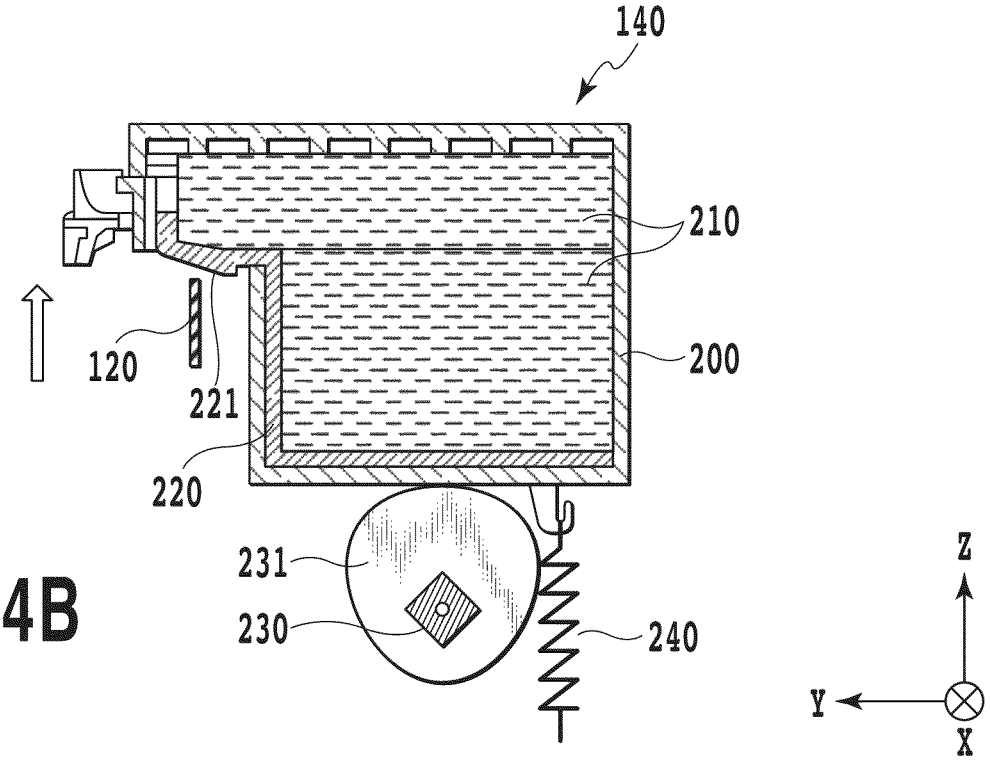

The movement between the two positions shown in FIGS. 4A and 4B is achieved by the rotation of an eccentric cam 231 rotating about a cam shaft 230, and the urging of a spring 240 downward in the vertical direction. The torque of the cam shaft 230 is obtained by transferring the drive force of the lift motor B106 via a gear (not shown). A sensor is provided near the eccentric cam 231 for detecting a position of the eccentric cam 231. It can be determined based on the detection of the sensor whether the wetting liquid retaining unit 140 is in the first position or the second position.

Because of such arrangement, while the wetting liquid retaining unit 140 is evacuated to the second position, the wiper 120 is moved to the transfer position in the Y direction, and then the wetting liquid retaining unit 140 is moved downward in the Z direction such that the transferring portion 221 can make contact with the wiper 120. In another possible manner, the wetting liquid retaining unit 140 is moved upward in the Z direction to separate the transferring portion 221 from the wiper 120, and then the wiper 120 can be moved in the Y direction to a position where the wiper 120 waits to wipe the print head (wiping position). That is, the transferring portion 221 can make contact with the wiper 120 in the Z direction (vertical direction), but the wiper 120 is not acted upon by drag which is produced in the Y direction upon movement of the wiper 120. As a result, while the wiper 120 is not much acted upon by drag in the thickness direction (Y direction) or the width direction (X direction) and also not much affected by rubbing against the transferring portion, the transfer of the wetting liquid to the wiper can be achieved with drag in the height direction (Z direction) alone in which relatively flexible deformation is allowed. That is, with the structure according to the present embodiment, as compared with related-art structure in which a wiper is horizontally moved to receive the wetting liquid transferred from a stationary transferring portion, the load on the wiper in the wiping operation is reduced, thus inhibiting the deterioration of the wiper itself and increasing the life of the wiper itself.

In the foregoing structure, the wetting liquid retaining unit 190 is moved downward from an upper area by the lift motor B106 as a drive source to make contact with the wiper 120, but the present invention is not limited to such structure. For example, the cam shaft 230 may be formed to be rotated by the feed motor as a drive source as in the case of the wiper 120.

Figure 6:
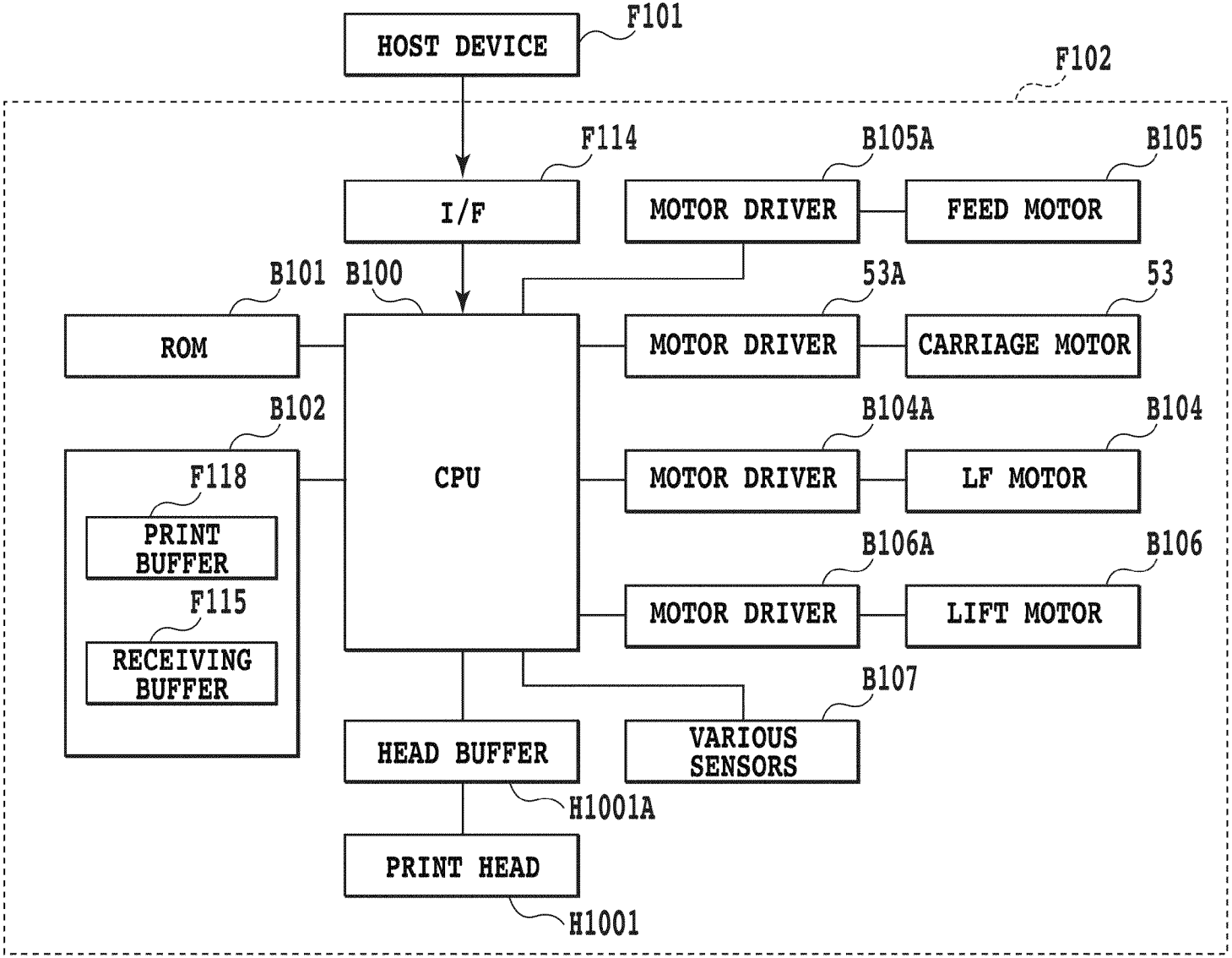
FIG. 6 is a schematic block diagram illustrating the structure of a control system in a printing apparatus available in the present invention.

FIG. 6 is a schematic block diagram illustrating the construction of a control system in a printing apparatus in the present embodiment. Image data transmitted from a host device F101 connected to the external is received via an interface (I/F) F114. A CPU B100 uses a RAM B102 as a work area and executes operation control on the entire printing apparatus, image data processing and the like in accordance with various programs and parameters stored in a ROM B101. For example, the CPU B100 temporarily stores the image data received from the host device B101 in a receiving buffer B115 within the RAM B102, and then executes a series of image processing with use of various parameters stored in the ROM B101. The CPU B100 counts the number of wiping operations to obtain the amount of the wetting liquid remaining in the wetting liquid tank, and adjusts the contact time and the intrusion amount of the transferring portion 221 and the wiper 120 in a wiping operation according to the remaining amount of the wetting liquid.

The image data subjected to a series of image processing is stored in a print buffer B118 within the RAM B102, and then sequentially passed to a head driver H1001A during the progress of the print operation of the print head H1001. The head driver H1001A drives the print head H1001 based on a received print signal. To carry out ink ejection from the print head H1001, the CPU B100 applies drive data (print data) for an electro-thermal transducer element and a drive control signal (heat pulse signal) to the head driver H1001A.

Concurrently with the ejection operation of the print head H1001, the CPU B100 drives the carriage motor 53 via a carriage motor driver 53A for performing a scan of the carriage 50 at a predetermined speed. Thereby, a print main scan is executed one time. Upon completion of the one-time print main scan, the CPU B100 drives the conveying motor B104 via a conveying motor driver B104A to rotate the conveying roller 30, thus conveying the print medium by a predetermined amount (sub scan). By repeating the print main scan and the sub scan in alternate order, the image received from the host device F101 can be printed on the print medium.

For a feeding operation, the CPU B100 drives the feed motor B105 via a feed motor driver B105A to rotate the feed roller, thus feeding a print medium into the apparatus. The CPU B100 drives the lift motor B106 via a lift motor driver B106A to rotate the eccentric cam 231, thus moving the wetting liquid retaining unit 190 upward/downward.

The CPU B100 performs various types of control according to results of detection of the various sensors B107. The various sensors include a temperature sensor for measuring an environment temperature, an optical sensor for determining whether or not the ink tank is mounted, a feed sensor for determining whether or not a print medium is normally fed, a sensor for acquiring a current position of the wetting liquid retaining member, and the like.

Figure 7:
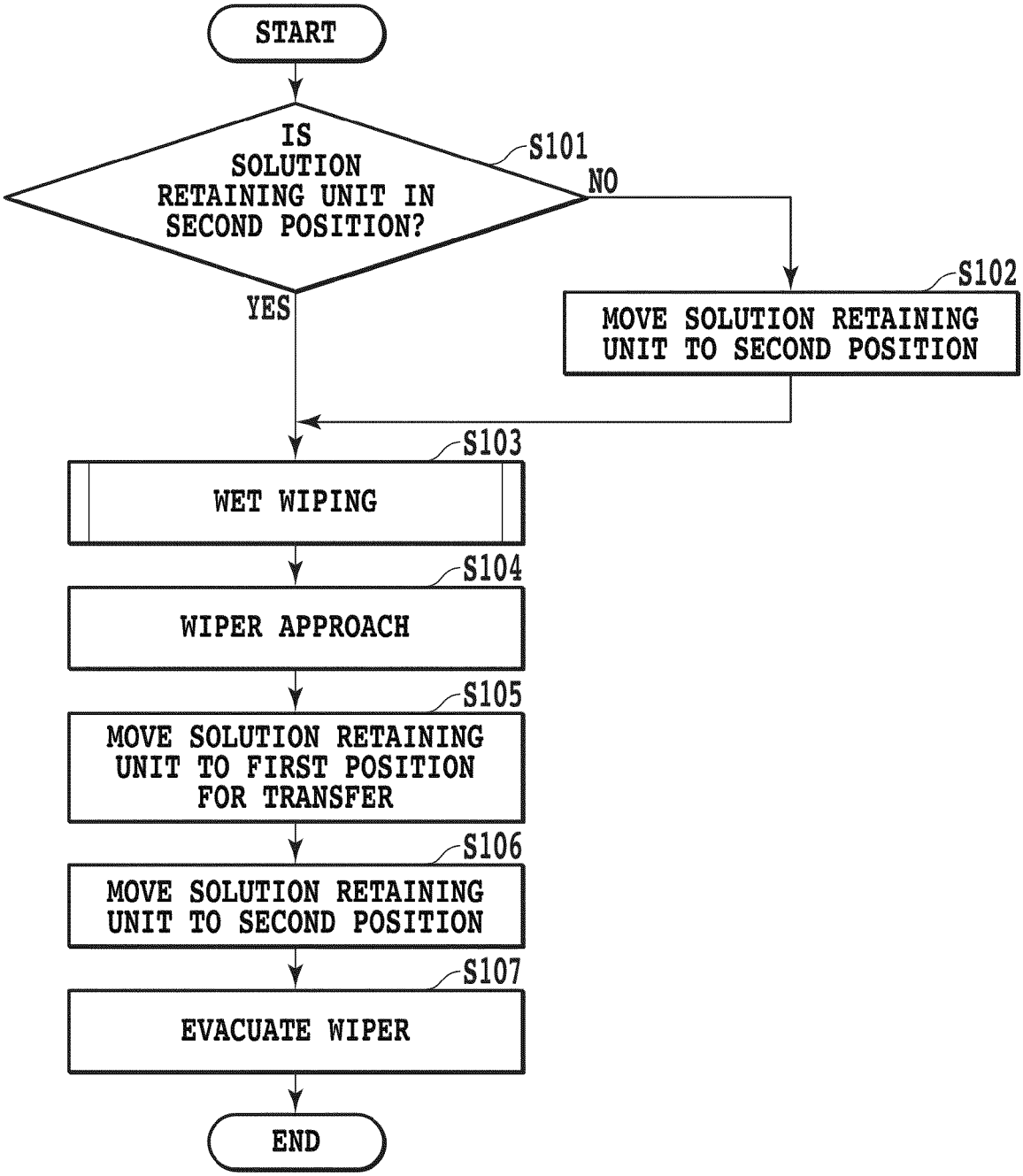
FIG. 7 is a flow chart illustrating the control process executed by a CPU in the wiping operation.

FIG. 7 is a flowchart illustrating control processes executed by the CPU B100 in the wiping operation.

Upon start of the wiping operation, first, the CPU B100 determines at step S101 from the result output from a sensor placed near the eccentric cam 231 whether or not the wetting liquid retaining unit 140 is in the second position. When it is determined that the wetting liquid retaining unit 190 is in the second position (evacuation position), the flow goes to step S103 without any process. On the other hand, when it is determined that the wetting liquid retaining unit 140 is not in the second position (evacuation position), the CPU B100 drives the lift motor B106 at step S102 to move (evacuate) the wetting liquid retaining unit 190 to the second position, and then the flow goes to step S103.

At step S103, commonly known wet wiping is performed. Specifically, the CPU B100 drives the carriage motor 53 to move the carriage 50 to its home position in which wiping can be performed. Then, while the carriage 50 is in the home position, the wiper holder 121 is moved in the Y direction to wipe the ejection opening face of the print head H1001. Thereafter, the preliminary ejection operation and the like are performed and then the carriage 50 is evacuated from the home position.

Upon completion of such a wet wiping process, the wetting liquid is transferred to the wiper 120 to provide for the next wet wiping process. To achieve this, first, at step S104 the wiper holder 121 is moved in the −Y direction to place the wiper 120 in the transfer position. At this stage, the wetting liquid retaining unit 140 is in the second position (evacuation position), so that the wiper 120 does not make contact with the wetting liquid transferring portion 221.

Next, at step S105, the CPU B100 drives the lift motor B106 to rotate the eccentric cam 231 and to move the wetting liquid retaining unit 140 downward to the first position (transfer position). By this operation, the wiper 120 and the transferring portion 221 make contact with each other as shown in FIG. 4A. In this manner, since the transferring portion 221 is moved downward from the above of the wiper 120 to contact with the wiper 120 which is during a halt and has a length in the Z direction, the wiper 120 is slowly bent as shown in FIG. 4A and the wetting liquid can be transferred to the surface of the wiper 120.

Upon completion of the transferring process at step S105, the flow goes to step S106 to move the wetting liquid retaining unit upward back to the second position (evacuation position). Then, at step S107, the wiper holder 121 is moved in the +Y direction to separate the wiper 120 from the transfer position. Then, the processing is terminated.

According to the above-described present embodiment, the wetting liquid can be reliably transferred to the surface of the wiper 120 without drag acting on the side face of the wiper 120. In consequence, without deterioration of the wiper and a reduction in wiper life which are caused by the rubbing of the transferring portion and the wiper against each other and the like, the wiping operation is able to be stably performed irrespective of the number of wiping operations.

(Embodiment 2)

The present embodiment employs a printing apparatus of the same structure as that in embodiment 1.

Referring to FIG. 5, when a large amount of the wetting liquid remains in the wetting liquid tank 200, since the force of forming meniscus in each fine pore is weak, the meniscus breaks easily and the meniscus does not move so far back into the inside of the fine pore after the meniscus has broken. For this reason, the wiper 120 is speedily wetted with the wetting liquid, which facilitates transfer of the wetting liquid to the wiper 120. On the other hand, when a relatively small amount of the wetting liquid remains in the wetting liquid tank 200, since the force of forming meniscus in each fine pore is strong, the meniscus does not easily break and the meniscus moves back after the meniscus has broken. For this reason, a longer time is required to wet the wiper 120 with the wetting liquid, and the wetting liquid is not easily transferred to the wiper 120. That is, there is concern that the amount of the wetting liquid transferred from the wetting liquid transfer member 210 to the wiper 120 is varied according to the amount of the wetting liquid remaining in the wetting liquid tank. In the present embodiment, the amount of movement of the wetting liquid transfer member 210 is adjusted to perform control for a reduction in change of the amount of the wetting liquid transferred.

Referring to FIGS. 4A and 4B again, the movement position of the wetting liquid retaining unit 190 can be adjusted by a rotation position of the eccentric cam 231 and a position of the spring. For example, as shown in FIG. 4B, when the wetting liquid retaining unit 140 is in contact with a portion of the periphery of the eccentric cam 231 located at the remotest distance from the cam shaft 230, the wetting liquid retaining unit 140 is placed in its highest position. As shown in FIG. 4A, when the wetting liquid retaining unit 140 is in contact with a portion of the periphery of the eccentric cam 231 located at the nearest distance from the cam shaft 230, the wetting liquid retaining unit 140 is placed in its lowest position. Accordingly, by adjustment of the rotation position of the eccentric cam 231, the first position for transfer of the wetting liquid to the wiper 120 can be selectively changed.

For example, in the case of a short duration of use of the printing apparatus and a large remaining amount of the wetting liquid, since a large amount of the wetting liquid is transferred to the wiper 120 through a very small contact, the first position can be set to a relatively high position, thus providing a smaller contact area between the transferring portion 221 and the wiper 120. On the other hand, in the case of a long duration of use of the printing apparatus and a small remaining amount of the wetting liquid, since a small amount of the wetting liquid is transferred to the wiper 120 through a very small contact, the first position can be set to a relatively low position, thus providing a larger contact area between the transferring portion 221 and the wiper 120. That is, estimation unit for estimating the remaining amount of the wetting liquid retained in the wetting liquid retaining unit 140 is provided. The first position of the wetting liquid retaining unit 140 can be changed according to a remaining amount of the wetting liquid estimated by the estimation unit. In this connection, as a method of using the estimation unit to estimate the remaining amount of the wetting liquid, a sensor may be provided for detecting the amount of the wetting liquid remaining in the wetting liquid retaining unit 140. Alternatively, the remaining amount of the wetting liquid may be estimated from the number of transfers of the wetting liquid to the wiper 120. The remaining amount of the wetting liquid may be estimated in accordance with environment of use of the printer. With the above-described structures, irrespective of the remaining amount of the wetting liquid, the amount of the wetting liquid transferred from the transferring portion 221 to the wiper 120 can be stabilized.

With the structure of the present embodiment, since the transferring portion 221 comes into contact with the wiper 120 during a halt while moving downward in the Y direction, forces in the X direction and the Y direction do not act on the wiper 120 regardless of the degree in the contact area. That is, without addition of drag from the side face of the wiper 120, the rubbing against the transferring portion, the wetting liquid can be reliably transferred to the surface of the wiper 120. As a result, as compared with the related-art structure in which a wiper is moved to a stationary transferring portion for transfer of a wetting liquid, the load on the wiper approaching or retreating can be reduced, thus inhibiting the deterioration of the wiper itself and increasing the life thereof.

(Embodiment 3)

Even when a reduction of the remaining amount of the wetting liquid brings about a reduction in the amount of the wetting liquid transferred to the wiper, if a sufficient amount of the wetting liquid is transferred to the ejection opening face when the print head is actually wiped, a large problem does not arise in the printing apparatus. As a result, a plurality of wipers are prepared beforehand and the wetting liquid is transferred to the wipers. This makes it possible to ensure a minimum amount of the wetting liquid applied to the ejection opening face. The present embodiment will describe an example of the use of the same printing apparatus as that in the aforementioned embodiments and the use of three wipers prepared beforehand.

Figure 8:
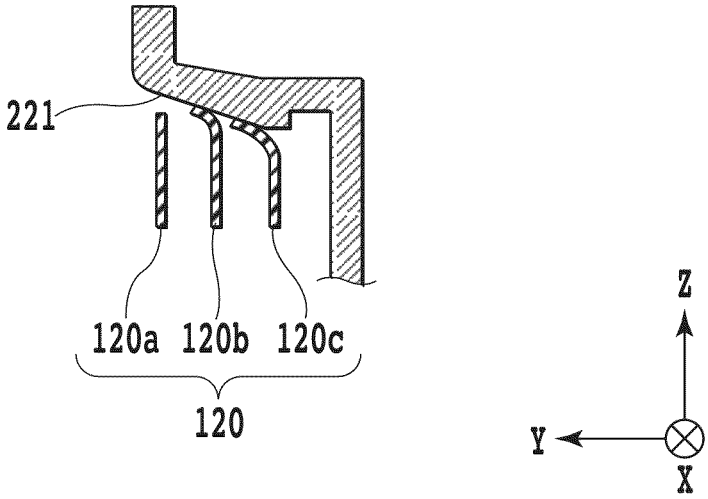
FIG. 8 is a diagram illustrating the structure of the three wipers and the transferring portion in an embodiment 3.

FIG. 8 is a diagram illustrating the structure of the three wipers 120 and the transferring portion 221 in the present embodiment. Typically, the transferring portion 221 is formed of a slope having an inclination in the Z direction as shown in FIG. 8. The amount of the wetting liquid transferred to the individual wipers is changed according to the lengths of the wipers, arrangement of the wipers and the gradient of the slope. For example, in the example in FIG. 8, the wetting liquid is transferred to the wipers 120*b* and 120*c* of the three wipers 120, but not transferred to the wiper 120*a*. Because the wiper 120*c* is located innermost or closer to the wetting liquid retaining unit 140 than the wiper 120*b* is located (the −Y direction), a larger amount of the wets solution is transferred to the wiper 120*c*.

Figure 9C:
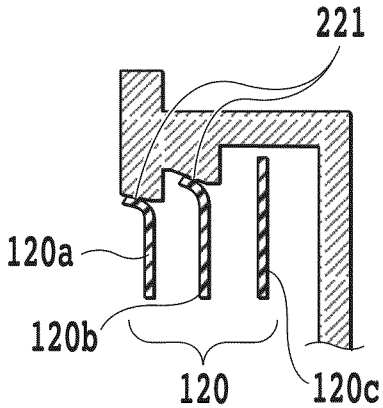

FIGS. 9A to 9C are diagrams respectively illustrating other examples of the transferring portion 221 having the three wipers 120. In each of the examples, the transferring portion 221 is provided with areas for the respective wipers 120*a* to 120*c*, and a height and an inclination of the slope in each area are defined for the corresponding one of the wipers 120*a* to 120*c*.

For example, in the transferring portion 221 with a homogeneous slope as shown in FIG. 8, the wetting liquid may possibly not be transferred to the wiper 120*a* located outermost (the +Y direction). However, if the areas of the transferring portion 221 are prepared for the respective wipers 120*a* to 120*c* as shown in FIG. 9A, the wiper 120*a* can come into contact with the transferring portion 221 on approximately the same contact area as that of the other two wipers and receive approximately the same amount of the wetting liquid transferred.

As shown in FIG. 9B, even when a shorter wiper 120*b* than the other wipers exists, if the transferring portion is provided in a lower position for the wiper 120*b*, the wiper 120*b* can also come into contact with the transferring portion 221 on approximately the same contact area as that of the other two wipers and receive approximately the same amount of the wetting liquid transferred as that.

As shown in FIG. 9C, the transferring portion is not provided in the area assigned to a specific wiper 120*c* of a plurality of wipers (in which the wiper does not reach the transferring portion), so that the wetting liquid may not be transferred to the wiper 120*c*.

When the wipers 120*a* to 120*c* differ in materials and thickness from each other, the contact amount can be set for each of wipers 120*a* to 120*c* as appropriate.

In this manner, with the structure of the present embodiment, the transferring portion can be varied in shape from area to area with which the wipers respectively make contact, so that the application amount of the wetting liquid applied to each of a plurality of wipers can be adjusted.

In the aforementioned structure, the structure of adjusting the amount of upward/downward movement of the transferring portion 221 as described in embodiment 2 is employed, thereby making it possible to change presence/absence of and the amount of the wetting liquid transferred to each of the wipers 120*a* to 120*c* as necessary. As a result, in the present embodiment using a plurality of wipers, the amount of the wetting liquid transferred to the ejection opening face of the print head can be more stabilized than the aforementioned embodiments.

(Embodiment 4)

The foregoing description has been given based on the example of the wet wiping for applying the wetting liquid to the ejection opening face. However, some printing apparatuses may not require wet wiping performed for each wiping operation. Wet wiping may be basically performed but the wetting liquid may not be required to be applied to the wiper in each wiping operation. In such cases, the CPU determines whether or not the wetting liquid is required to be transferred to the wiper, and is capable of selectively switching between the wiping with the transfer of wetting liquid (wet wiping) and the wiping without the transfer of wetting liquid (regular wiping).

Figure 10:
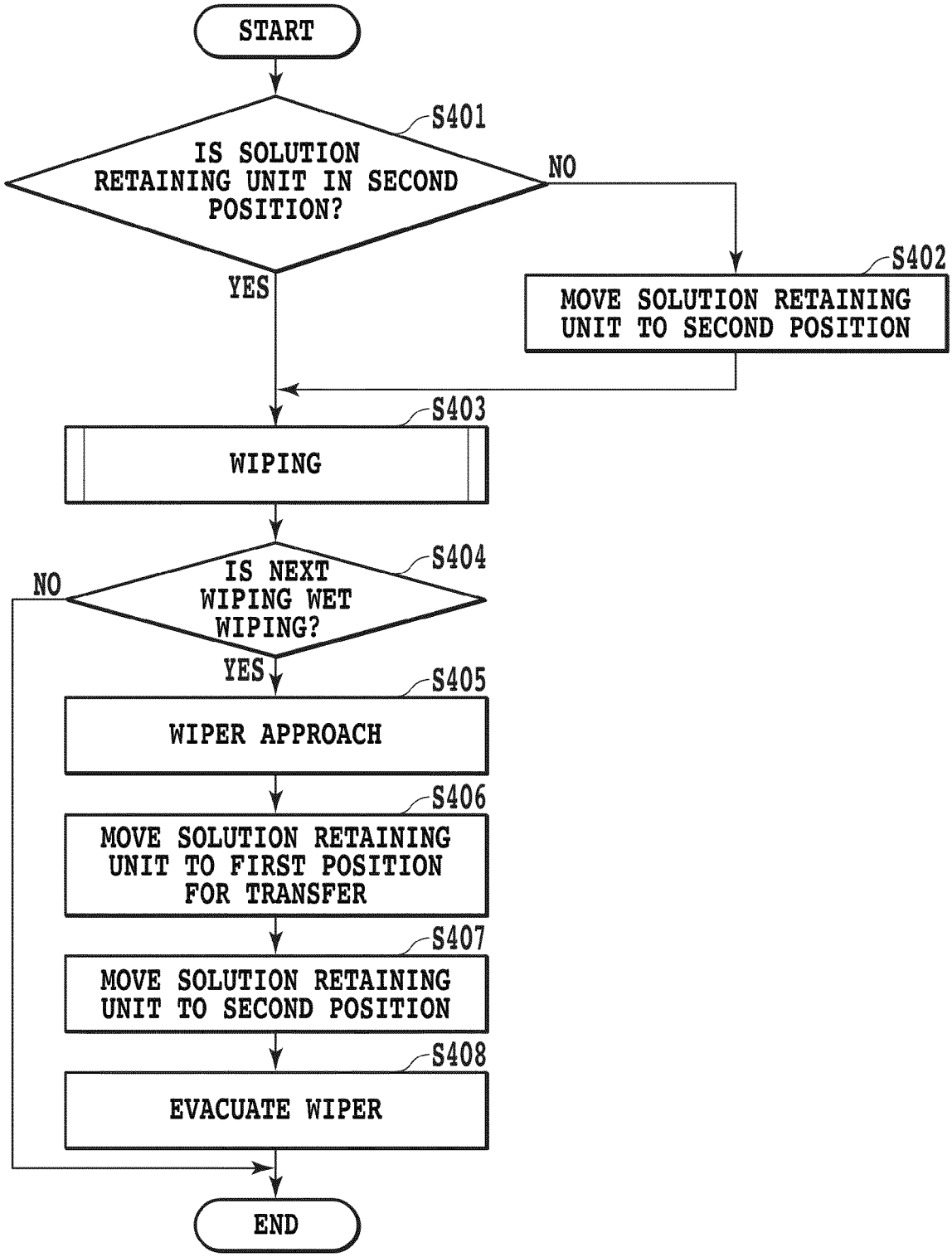
FIG. 10 is a flow chart illustrating the control process executed by a CPU B100 in a wiping operation in an embodiment 4.

FIG. 10 is a flowchart illustrating control processes executed by the CPU B100 in the wiping operation in the present embodiment.

Upon start of the wiping operation, first, the CPU B100 determines at step S401 whether or not the wetting liquid retaining unit 140 is in the second position. When it is determined that the wetting liquid retaining unit 140 is in the second position (evacuation position), the flow goes to step S403 without any process. On the other hand, when it is determined that the wetting liquid retaining unit 140 is not in the second position (evacuation position), the CPU B100 drives the lift motor B106 at step S402 to move (evacuate) the wetting liquid retaining unit 140 to the second position, and then the flow goes to step S403.

At step S403, a commonly-known wiping operation is performed. At this stage, if the wetting liquid is already transferred to the wiper 120, the wet wiping is performed, but if the wetting liquid is not transferred, regular wiping, that is, wiping with a wetting liquid not applied to the ejection opening face, is performed.

Upon completion of the wiping operation, it is determined at step S404 whether or not the next wiping is wet wiping. When it is determined that the next wiping is wet wiping, the flow goes to step S405 to transfer the wetting liquid to the wiper 120 for the next wet wiping. The processes in steps S405 to S408 correspond to the processes in step S104 to S107 in FIG. 7, and therefore, the description herein is omitted.

On the other hand, when it is determined at step S404 that the next wiping is not wet wiping, there is no need to transfer the wetting liquid to the wiper 120 for the next wet wiping, thus terminating the present processing.

According to the aforementioned present embodiment, in the wiping operation in which the wetting liquid is not transferred, while the wetting liquid retaining unit 140 is evacuated to the second position, the wiping operation can be finished. Accordingly, it is possible to perform a wiping operation involving selective switching between the wiping with transfer of the wetting liquid and the wiping without transfer of the wetting liquid.

The foregoing embodiments have described, as described in FIG. 7 and FIG. 10, the form in which the wetting liquid retaining unit 140 is evacuated to the second position at both of the timings when the wiper intrudes into and retreats from the transfer position. However, the present invention is not limited to such structure. For example, even in the structure in which the wetting liquid retaining unit 140 is evacuated to the second position only either when the wiper intrudes into the transfer position or when the wiper retreats from the transferring portion, the load on the wiper is reduced as compared with the related-art structure, achieving advantageous effects of the present invention. In particular, as shown in FIG. 8, when the transferring portion has an inclination in the movement direction of the wiper, the drag in the Y direction from the transferring portion 221 acting on the wiper 120 is also deflected to the Z direction. Thus, a great rub does not occur between the transferring portion and the wiper. As a result, in such a case, the wetting liquid retaining unit may be placed in the first position before the wiper intrudes, and only at evacuating, the wetting liquid retaining unit may be evacuated before the wiper retreats. By doing so, the time required to move the wetting liquid transfer unit can be reduced, resulting in completion of wiping operation in a short time.

while the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-086026, filed Apr. 2, 2010, which is hereby incorporated by reference herein in its entirety.

What is claimed is:

1. An inkjet printing apparatus comprising:

a print head having an ejection opening face in which ejection openings are formed to eject ink;

a wiper for wiping the ejection opening face;

a wetting liquid retaining unit including a transferring portion coming into contact with the wiper to transfer a wetting liquid to the wiper; and a moving unit configured to move the wetting liquid retaining unit to a first position where the wiper can contact with the transferring portion, and to a second position located above the first position in a vertical direction where the wiper cannot contact the transferring portion, wherein the moving unit moves the wetting liquid retaining unit from the second position to the first position to allow the wiper and the transferring portion to come into contact with each other.

2. The inkjet printing apparatus according to claim 1, wherein the wiper is capable of being moved to a wiping position for making contact with the ejection opening face and to a transfer position in which contact with the transferring portion is allowed.

3. The inkjet printing apparatus according to claim 2, wherein the apparatus includes a controller configured to control the apparatus so that, after the wiper is moved to the transfer position, the moving unit moves the wetting liquid retaining unit from the second position to the first position.

4. The inkjet printing apparatus according to claim 3, wherein the controller is configured to control the apparatus so that, after the moving unit moves the wetting liquid retaining unit from the first position to the second position, the wiper is moved from the transfer position.

5. The inkjet printing apparatus according to claim 1, further comprising:

an estimation unit configured to estimate a remaining amount of the wetting liquid retained in the wetting liquid retaining unit, wherein the first position is changed according to the remaining amount of the wetting liquid estimated by the estimation unit.

6. The inkjet printing apparatus according to claim 1, wherein the transferring portion has an inclination with respect to a direction in which the wiper intrudes and retreats.

7. The inkjet printing apparatus according to claim 1, wherein a plurality of the wipers are prepared.

8. The inkjet printing apparatus according to claim 1, wherein a plurality of the wipers are prepared and the transferring portion includes areas which are different in shape from each other to correspond to the plurality of the wipers respectively coming into contact with the areas.

9. The inkjet printing apparatus according to claim 1, further comprising:

a determination unit configured to determine whether or not the transfer of the wetting liquid is required, wherein when the determination unit determines that the transfer of the wetting liquid is required, the wiping is executed by the wiper after the wetting liquid is transferred from the transferring portion to the wiper, and when the determination unit determines that the transfer of the wetting liquid is not required, the wiping is executed by the wiper while the wetting liquid is not transferred from the transferring portion to the wiper.

10. The inkjet printing apparatus according to claim 1, wherein the ink contains a watercolor pigment.

11. A method of transferring a wetting liquid in an inkjet printing apparatus provided with a print head having an ejection opening face in which ejection openings are formed to eject ink, a wiper for wiping the ejection opening face, a wetting liquid retaining unit including a transferring portion coming into contact with the wiper to transfer a wetting liquid to the wiper, comprising:

a step to move the wetting liquid retaining unit from a first position where the wiper can contact with the transferring portion to a second position located above the first position in a vertical direction where the wiper cannot contact with the transferring portion;

a step to move the wiper to a transfer position in which contact with the transferring portion is allowed; and a step to move the wetting liquid retaining unit from the second position to the first position to provide contact between the wiper and the transferring portion.

* * * * *